US007643933B2

(12) United States Patent
Hirata

(10) Patent No.: US 7,643,933 B2
(45) Date of Patent: Jan. 5, 2010

(54) OVERTURN PREVENTION CONTROL DEVICE

(75) Inventor: Atsuhiko Hirata, Yasu (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/130,050

(22) Filed: May 30, 2008

(65) Prior Publication Data

US 2008/0228357 A1 Sep. 18, 2008

Related U.S. Application Data

(63) Continuation of application No. PCT/JP2006/321616, filed on Oct. 30, 2006.

(30) Foreign Application Priority Data

Dec. 1, 2005 (JP) ..... 2005-348373

(51) Int. Cl.
*B62D 37/04* (2006.01)

(52) U.S. Cl. ..... 701/124; 700/62; 340/440; 446/236; 446/237; 73/65.01; 73/65.07; 73/65.08

(58) Field of Classification Search ..... 180/282; 701/38, 124; 280/5.504, 5.506, 5.507, 5.508, 280/5.509, 755; 340/440; 114/122; 446/236, 446/237; 700/279; 73/65.07, 65.08
See application file for complete search history.

(56) References Cited

U.S. PATENT DOCUMENTS

| | | | | |
|---|---|---|---|---|
| 4,200,168 | A * | 4/1980 | Moog | 180/282 |
| 2005/0045398 | A1 | 3/2005 | Suzuki | |
| 2006/0085111 | A1 * | 4/2006 | Kojima | 701/38 |

FOREIGN PATENT DOCUMENTS

| | | | |
|---|---|---|---|
| JP | 56-60780 | A | 5/1981 |
| JP | 11-47454 | A | 2/1999 |
| JP | 2002-068063 | A | 3/2002 |
| JP | 2003-190654 | A | 7/2003 |
| JP | 2004-343871 | A | 12/2004 |
| WO | WO 2004/054678 | * | 7/2004 |

* cited by examiner

*Primary Examiner*—Khoi Tran
*Assistant Examiner*—Spencer Patton
(74) *Attorney, Agent, or Firm*—Keating and Bennett, LLP

(57) ABSTRACT

An overturn prevention control device includes a bicycle robot capable of freely laterally inclining, an angular velocity sensor mounted on the bicycle robot such that a detection axis thereof extends in a substantially longitudinal direction of the bicycle robot, a motor mounted on the body such that a rotating shaft thereof extends in a substantially longitudinal direction of the body, a rotation sensor that detects a rotational position or a rotational speed of the motor, and an inertial rotor coupled to the rotating shaft of the motor. The overturn prevention control device corrects inclination of the bicycle robot by rotating the inertial rotor using the motor and by utilizing a reaction torque occurring when the inertial rotor is rotated. The overturn prevention control device further includes an inclination angle estimating portion arranged to estimate an inclination angle relative to a balanced state.

5 Claims, 5 Drawing Sheets

FIG. 4

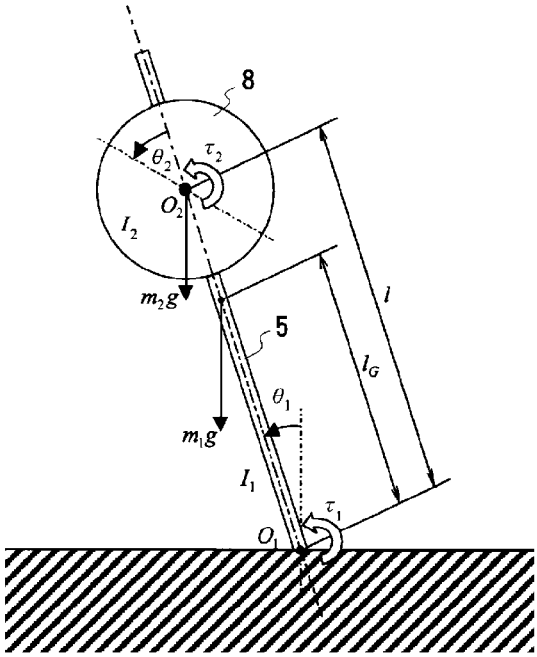

$O_1$ : GROUND POINT
$O_2$ : CENTER OF INERTIA ROTOR
$m_1$ : MASS OF BODY
$m_2$ : MASS OF INERTIA ROTOR
$I_1$ : MOMENT OF INERTIA OF BODY ABOUT $O_1$
$I_2$ : MOMENT OF INERTIA OF INERTIA ROTOR ABOUT $O_2$
$\theta_1$ : INCLINATION ANGLE OF BODY RELATIVE TO VERTICAL AXIS
$\theta_2$ : MOTOR TORQUE ON INERTIA ROTOR
$\tau_1$ : ROTATION ANGLE OF INERTIA ROTOR RELATIVE TO BODY
$\tau_2$ : DISTURBANCE TORQUE ON BODY ABOUT $O_1$
$l_G$ : DISTANCE FROM $O_1$ TO BARYCENTRIC POSITION OF BODY
$l$ : DISTANCE FROM $O_1$ TO $O_2$
$g$ : ACCELERATION OF GRAVITY

FIG. 5

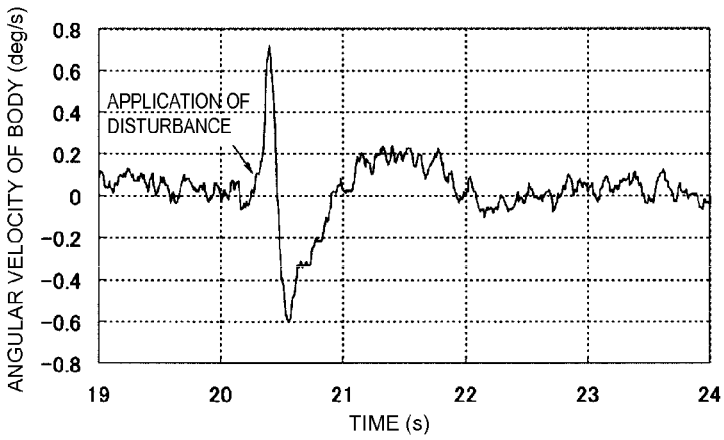

MEASUREMENT VALUE OF ANGULAR VELOCITY OF BODY MEASURED BY GYRO SENSOR WHEN DISTURBANCE IS APPLIED

MOTOR TORQUE COMMAND WHEN DISTURBANCE IS APPLIED (RATED TORQUE: 3 V)

ESTIMATE OF INCLINATION ANGLE OF BODY WHEN DISTURBANCE IS APPLIED

OVERTURN PREVENTION CONTROL DEVICE

BACKGROUND OF THE INVENTION

1. Field of the Invention

The present invention relates to an overturn prevention control device that controls balance to prevent overturning of a body that is capable of freely laterally inclining such as, for example, a two-wheel vehicle or a biped robot.

2. Description of the Related Art

Japanese Unexamined Patent Application Publication No. 2003-190654 describes a two-wheel traveling toy including a steering portion, a front wheel steerable by the steering portion, a rear wheel, a flywheel swinging in accordance with the direction of the front wheel, a first driving portion arranged to drive the flywheel, and a second driving portion arranged to drive the rear wheel. The two-wheel vehicle is resistant to overturning while traveling due to the gyro effect of the flywheel produced by changing the direction of the flywheel in accordance with the direction of the front wheel.

However, in the aforementioned two-wheel traveling toy, because the direction of the flywheel is merely changed in accordance with the direction of the front wheel, although the vehicle is prevented from overturning during normal travel by steering, it is difficult to prevent the vehicle from overturning when stopped or while moving at a very low speed by steering alone. As a result, there is a problem in that overturning cannot be effectively prevented.

Japanese Unexamined Patent Application Publication No. 11-47454 describes an inversion control toy in which overturning is prevented by inputting an inclination detected by an inclination detecting sensor into a control circuit, driving of a motor using the control circuit, rotating a high-inertia rotor using the motor, and generating a reaction couple by increasing the number of revolutions of the rotor in the direction opposite to the direction in which the inclination is to be corrected. This inversion control toy maintains its balance by controlling the revolutions of the rotor, such that overturning is prevented even when stopped or when the toy moves at a very low speed.

The above-described inversion control toy uses, as the inclination detecting sensor, an optical sensor that detects an inclination using a photo detector receiving light reflected from the surface of the floor after being emitted from a light-emitting device. However, in practice, it is not easy to accurately detect the inclination. For an inclination detecting sensor that uses a light-emitting device and a photo detector, although there is no problem when the surface of the floor that is to reflect light is flat, it is impossible to accurately detect the inclination when the surface of the floor is uneven or the floor is not present on both sides (for example, when the toy crosses a narrow bridge).

In addition, the above-described inversion control toy detects the inclination by obtaining the difference from the amount of received light in an upright state as the reference amount. However, the upright state (in a vertical direction) is not always a balanced state. For example, when the position of the center of gravity of the toy is laterally displaced from the central position or when the toy is subjected to a side wind, a state that is slightly inclined relative to the vertical direction is a balanced state. In this case, although that balanced state (angle) should be used as a reference position, the vertical direction is used as the reference position in the above-described method. Therefore, the toy may be unable to maintain its balance and may overturn.

One possible method of detecting the inclination of a body is detecting the angular velocity using an angular velocity sensor, integrating the detected value, and thereby estimating the inclination. However, in the method of integrating the output angular velocity, a problem arises in that noises or offsets are accumulated and it is not possible to continue to estimate an inclination angle and prevent overturning. Another device for detecting an inclination is an inclination sensor that uses a weight. However, in this case, the inclination corresponding to a balanced state cannot be detected, and additionally, responsiveness is poor, resulting in a disadvantage in that the inclination cannot be immediately detected.

SUMMARY OF THE INVENTION

To overcome the problems described above, preferred embodiments of the present invention provide an overturn prevention device that is capable of accurately estimating an inclination angle from a balanced state without accumulating noises and offsets, and that is also capable of continuing to estimate an inclination angle and prevent overturning.

According to a preferred embodiment of the present invention, an overturn prevention control device includes a body capable of freely laterally inclining, an angular velocity sensor mounted on the body such that a detection axis thereof extends in a substantially longitudinal direction of the body, a motor mounted on the body such that a rotating shaft thereof extends in a substantially longitudinal direction of the body, a rotation sensor that detects a rotational position or a rotational speed of the motor, and an inertial rotor coupled to the rotating shaft of the motor. The overturn prevention control device corrects the inclination of the body by rotating the inertial rotor using the motor and by using a reaction torque occurring when the inertial rotor is rotated. The overturn prevention control device further includes an inclination angle estimating portion arranged to estimate an inclination angle of the body relative to a balanced state from an angular velocity output $\omega_1$ from the angular velocity sensor and a torque command $\tau_0$ to be supplied to the motor. The overturn prevention control device corrects the inclination of the body using an estimate of the inclination angle estimated by the inclination angle estimating portion.

An operating principle of the overturn prevention control device according to preferred embodiments the present invention is the rotation of the inertia rotor using the motor and the correction of the inclination of the body by using the reaction torque occurring when the inertia rotor is rotated, as in Japanese Unexamined Patent Application Publication No. 11-47454. For the correction, it is necessary to precisely detect the inclination angle. In preferred embodiments of the present invention, the inclination angle is not directly detected by a sensor, and the inclination is not determined by integration of an angular velocity output from the angular velocity sensor. That is, the inclination angle is estimated from the angular velocity output $\omega_1$ from the angular velocity sensor and the torque command $\tau_0$ to be supplied to the motor. The inclination angle is an angle that is deviated from the attitude of the body in a balanced state at which the total of the torque produced by gravity, the centrifugal force produced by traveling in a curve, and the disturbance torque caused by, for example, a side wind is zero. The rotation of the inertia rotor is controlled based on the estimate of the inclination angle, and the torque of the motor is repeatedly controlled such that the inclination angle converges to zero. For example, when the inclination angle is left relative to the balanced axis of the body viewed from the front of the body, in order to maintain the balanced attitude, the inertia rotor is accelerated in the direction of left-hand rotation when viewed from the front of the body. On the other hand, when the inclination angle is right relative to the balanced axis of the body viewed from the front of the body, in order to maintain the balanced attitude, the inertia rotor is accelerated in the direction of right-hand rotation when viewed from the front of the body.

In preferred embodiments of the present invention, because an inclination detecting sensor is not used to detect the inclination angle of the body, the inclination is accurately detectable even when the surface of the floor is uneven or the floor is absent on both sides, such as in the case of a balance beam. In addition, because it is not necessary to integrate an angular velocity output from the angular velocity sensor, even when the output from the angular velocity sensor includes a noise or offset, the estimation of the inclination angle can be continued and control for preventing overturning can be continued. Furthermore, as compared to when a traditional inclination sensor that uses a weight is used, the responsivity is greatly improved, such that the inclination is precisely detectable. As described above, according to preferred embodiments of the present invention, the inclination angle of the body from the balanced axis is detectable with high precision and in a very responsive manner, such that the torque to be supplied to the motor corresponding to this inclination angle is precisely controllable. By using a reaction torque of the torque applied to the inertia rotor from the motor, the inclination angle of the body is precisely controllable in a direction in which the body is prevented from overturning. As a result, a structure that does not overturn even when stopped or moving at a very low speed is provided.

According to a preferred embodiment of the present invention, the overturn prevention control device may preferably further include an inclination angular velocity command generating portion arranged to generate an inclination angular velocity command $\omega_2$ using an inclination angle deviation signal in which the estimate of the inclination angle is subtracted from a target inclination angle and a torque command generating portion arranged to generate the torque command $\tau_0$ to be supplied to the motor using an inclination angular velocity deviation signal $\omega_2$-$\omega_1$, in which the angular velocity output $\omega_1$ from the angular velocity sensor is subtracted from the inclination angular velocity command $\omega_2$. First, the target inclination angle is set, the inclination angle deviation signal is obtained by subtracting the estimate of the inclination angle from the target inclination angle, and the inclination angular velocity command $\omega_2$ to the body is generated from this deviation signal. Then, the torque command $\tau_0$ to be supplied to the motor can be generated using the inclination angular velocity deviation signal $\omega_2$-$\omega_1$, in which the angular velocity output $\omega_1$ from the angular velocity sensor is subtracted from the inclination angular velocity command $\omega_2$.

According to a preferred embodiment of the present invention, the overturn prevention control device may preferably further include an external torque estimating portion arranged to estimate an external torque that urges the body to fall from the estimate of the inclination angle and a torque correcting portion arranged to correct the torque command $\tau_0$ in a direction in which the external torque is cancelled using an estimate $\tau_3$ of the external torque. The external torque is a torque in the direction of inclination caused by the gravity imposed on the body resulting from inclination of the body from the balanced axis and by disturbances. Compensating for the external torque using feedforward control enables overturn prevention control to continue even when the response frequency of each of the inclination angle loop and the inclination angular velocity loop is low. Accordingly, stable control can be performed.

According to a preferred embodiment of the present invention, the overturn prevention control device may preferably further include a target inclination angle generating portion arranged to generate the target inclination angle using the rotational speed of the motor in a direction in which the rotational speed is reduced. Because the angular momentum possessed by the inertia rotor can be released using the torque produced by gravity. Accordingly, the control can continue without causing the rotational speed of the motor to exceed its limit.

The overturn prevention control device according to preferred embodiments of the present invention is applicable to an autonomous traveling two-wheel vehicle. This two-wheel vehicle may have a steering portion, a front wheel steerable by the steering portion, a rear wheel, a rear-wheel driving portion that drives the rear wheel, and a frame that rotatably supports the front wheel and the rear wheel. By using preferred embodiments of the present invention to prevent a two-wheel vehicle from overturning, a two-wheel vehicle that does not overturn even when stopped or moving at a very low speed, in addition to during normal travel, is provided. The overturn prevention control can be used during stops or while the vehicle moves at a very low speed, and, during travel, the vehicle can maintain upright orientation by manipulating the steering portion without rotating the inertia rotor during travel.

As described above, according to preferred embodiments of the present invention, the inclination angle relative to the balanced state is estimated from the angular velocity output from the angular velocity sensor and the motor torque command. Therefore, in contrast to when a traditional inclination detecting sensor is used, the inclination angle relative to the balanced state can be accurately estimated even when the surface of the floor is uneven, when the floor is absent in neighboring areas, such as in the case of a balance beam, or when the surface of the floor is slightly tilted. In addition, because it is not necessary to integrate an angular velocity output from the angular velocity sensor, even when the output from the angular velocity sensor includes a noise or offset, the estimation of the inclination angle can continue and control to prevent overturning can continue. Furthermore, as compared to when a traditional inclination sensor that uses a weight is used, the responsivity is greatly improved, such that the inclination can be precisely estimated. As a result, the torque to be added to the motor torque is precisely controllable, and an overturn prevention control device that does not allow overturning even when stopped or traveling at a very low speed is obtained.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 4 is a model diagram viewed from the front of the bicycle robot.

FIG. 5 shows a measurement value of an angular velocity of a body measured by a gyro sensor when a disturbance is applied.

DETAILED DESCRIPTION OF PREFERRED EMBODIMENTS

Preferred embodiments of the present invention will be described below with reference to the drawings.

First Preferred Embodiment

Figure 1:
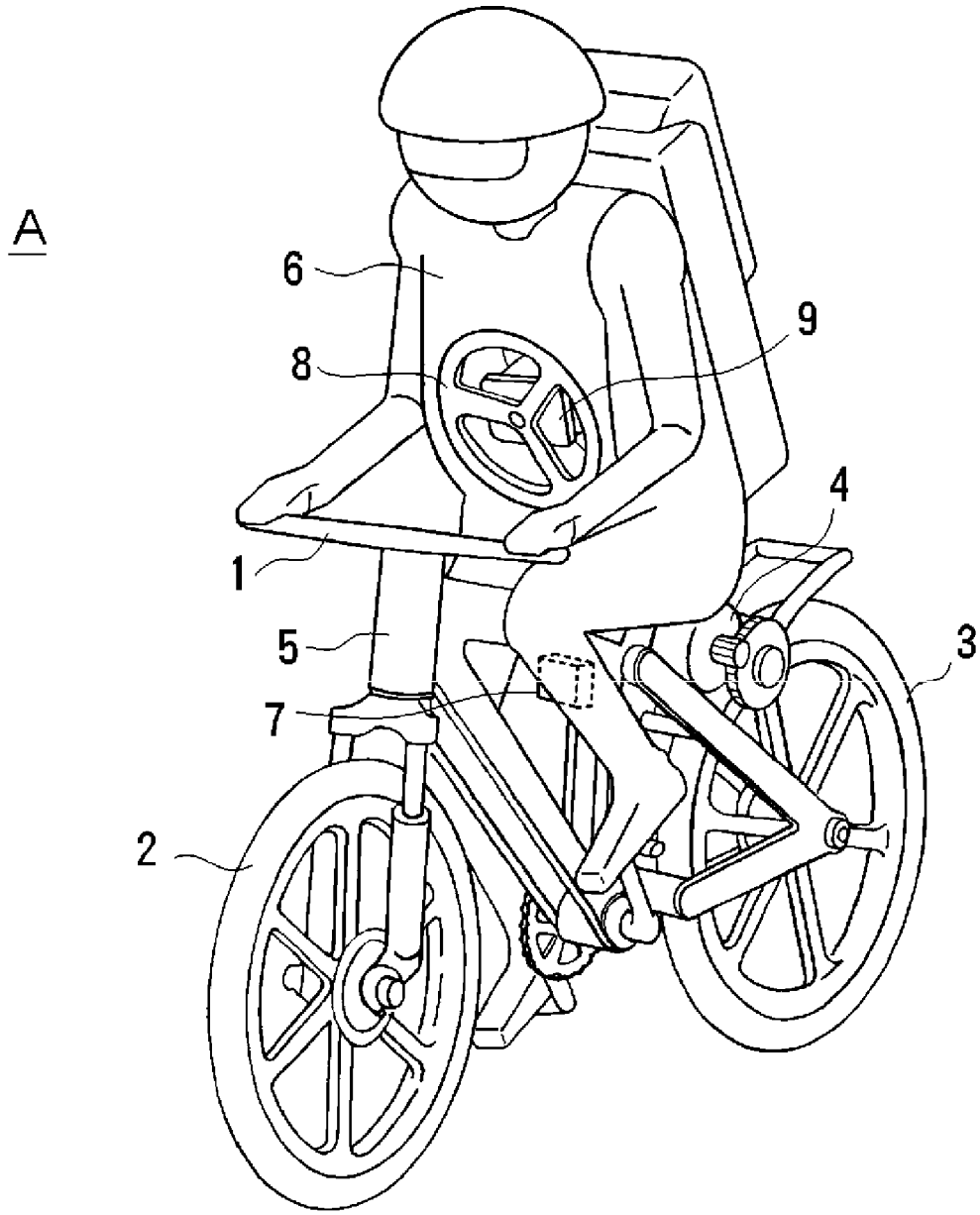
FIG. 1 is a perspective view of a preferred embodiment of a bicycle robot to which an overturn prevention control device according to the present invention is applied.
Figure 2:
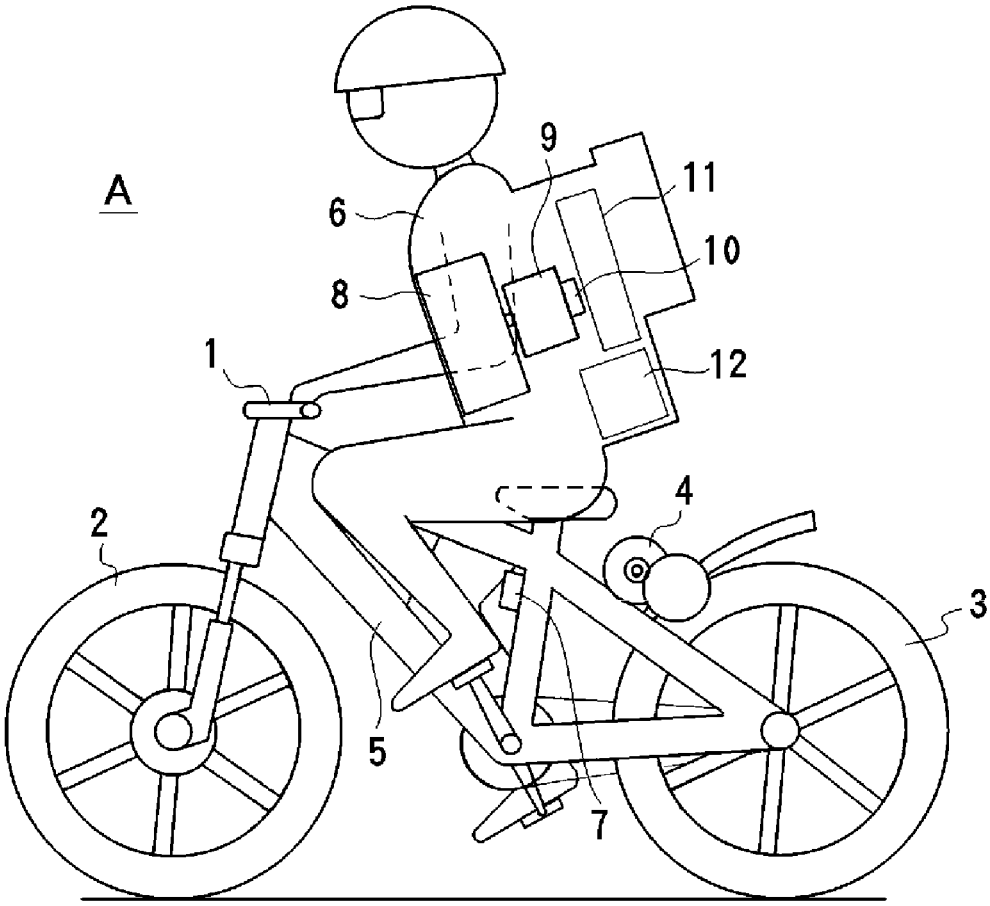
FIG. 2 is a side view of the bicycle robot.
Figure 3:
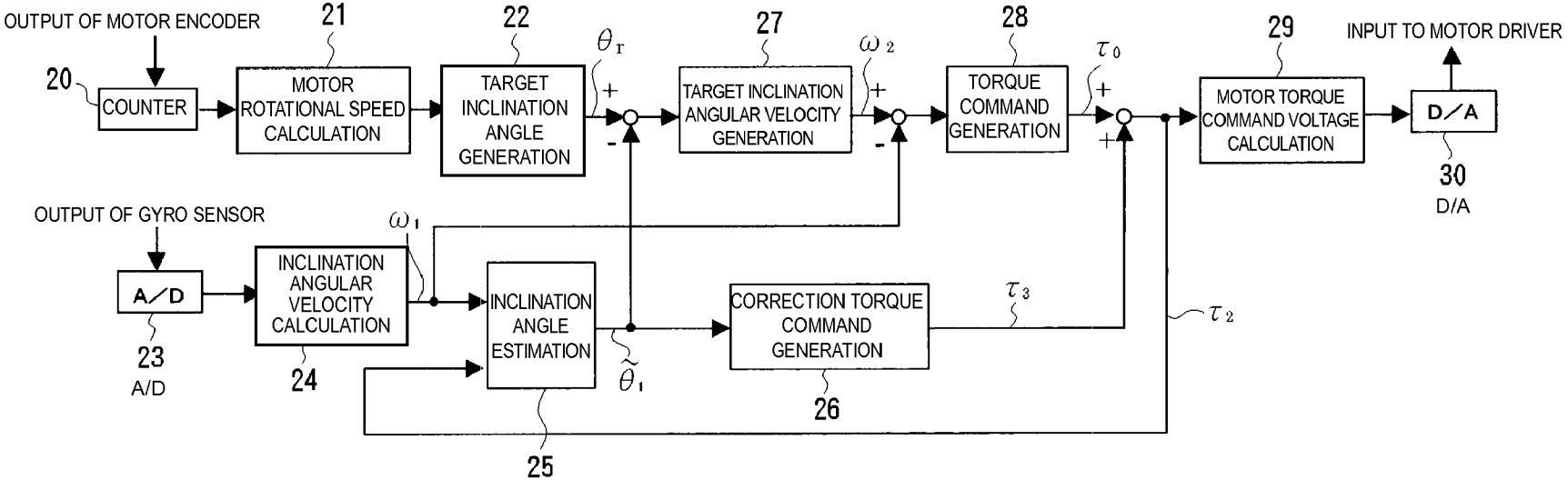
FIG. 3 is a control block diagram of the bicycle robot.

FIGS. 1 to 3 illustrate a first preferred embodiment of the present invention in which an overturn prevention control device is applied to a bicycle robot.

The bicycle robot A preferably includes a steering handlebar 1, a front wheel 2 that is steerable by the steering handlebar 1, a rear wheel 3, a rear-wheel driving motor 4 that drives the rear wheel 3, a frame 5 supporting the front wheel 2 and the rear wheel 3 such that they are freely rotatable, and a doll 6 mounted on the frame 5. The frame 5 is equipped with a gyro sensor (angular velocity sensor) 7 to measure an inclination angular velocity such that a detection axis thereof extends in a substantially longitudinal direction of the bicycle robot A. An inertia rotor 8, a balance motor 9 arranged to drive the inertia rotor 8, and an encoder 10 arranged to measure a rotation angle of the balance motor 9 are mounted in the chest of the doll 6. Each of the rotating shaft of the inertia rotor 8 and the balance motor 9 also extend in a substantially longitudinal direction of the bicycle robot A. The substantially longitudinal direction used my be slightly displaced upward or downward from an exact longitudinal direction. A control substrate 11 for controlling the balance motor 9 and a battery 12 are mounted in the back of the doll 6. A driver for driving the motor 9, an analog-to-digital (A/D) converter, a D/A converter, a counter, a controller, and other elements are mounted on the control substrate 11.

During normal travel, overturning can be prevented by maintaining its balance by steering with the handlebar 1. During stops or when moving at a very low speed, because it is difficult to maintain the balance by steering with the handlebar 1 alone, the bicycle robot is controlled such that the balance is maintained by utilizing a reaction which occurs when the inertia rotor 8 is driven.

The bicycle robot A is controlled by a control block illustrated in FIG. 3. This control block is one example of a block stored in the control substrate 11. A counter 20 counts pulses output from the encoder 10. A motor speed calculator 21 converts the output of the counter 20 into a rotation angle and then differentiates it to determine a rotational speed of the balance motor 9. A low-pass filter (LPF) which provides noise reduction may be provided.

A target inclination angle generator 22 obtains a target inclination angle by multiplying the rotational speed of the balance motor 9 by a proportionality constant such that, when the rotational speed of the balance motor 9 indicates a left rotation when viewed from the front of the bicycle, the target inclination angle is rightward when viewed from the front of the bicycle and, when the rotational speed of the balance motor 9 indicates a right rotation when viewed from the front of the bicycle, the target inclination angle is leftward when viewed from the front of the bicycle. It is preferable that no steady rotation remains in the inertia rotor 8 by the addition of an integrator.

An A/D converter 23 measures an angular velocity output from the gyro sensor 7. An inclination angular velocity calculator 24 calculates an inclination angular velocity $\omega_1$ by multiplying the output angular velocity by a conversion factor.

An inclination angle estimating portion 25 calculates an inclination angle represented by Eq. (18), which will be described later, and derived from the equation of motion in the direction of an inclination angle in a system that includes the body of the bicycle (portions other than the inertia rotor) and the inertia rotor 8 from the inclination angular velocity $\omega_1$ and the motor torque command $\tau_2$. The inclination angle estimating portion 25 calculates the estimate of the inclination angle by adding a first-order lag element in series for stabilizing a loop by making it have an appropriate estimated speed. One specific example is that 1/(0.1S+1) is added as the first-order lag element in series corresponding to the calculated value obtained by use of Eq. (18). However, the present preferred embodiment is not limited to this example, and any lag element for obtaining an appropriate estimated speed can be added. The inclination angle is a deviation angle deviating from an attitude of the body in a balanced state at which the total of the torque produced by gravity, the centrifugal force produced by traveling around a curve, and a disturbance torque caused by, for example, a side wind is zero.

A correction torque command generator 26 generates a correction torque (i.e., an estimate of external torque) $\tau_3$ by calculating an estimate of an external torque acting on the bicycle by multiplying the estimate of the inclination angle by a conversion factor.

A target inclination angular velocity generator 27 generates a target inclination angular velocity $\omega_2$ by multiplying the deviation between the target inclination angle and the estimate of the inclination angle by a proportional gain.

A torque command generator 28 generates a torque command $\tau_0$ corresponding to the deviation between the target inclination angular velocity $\omega_2$ and the inclination angular velocity $\omega_1$ by use of, for example, PI control. A motor torque command voltage calculator 29 generates a command voltage by multiplying a motor torque $\tau_2$ in which the torque command $\tau_0$ and the correction torque $\tau_3$ are added together by a conversion factor. Lastly, a D/A converter 30 outputs the command voltage to the driver and controls the rotation of the balance motor 9.

A process for deriving a mathematical expression for calculating an estimated inclination angle represented by Eq. 18) will now be described below.

FIG. 4 illustrates a model including the inertia rotor 8 viewed from the front of the bicycle robot A. First, the equation of motion is derived from the Lagrange's equations. The total kinetic energy T and positional energy U of the body of the bicycle (portions other than the inertia rotor) and the inertia rotor 8 are expressed by the following:

$$T = \frac{1}{2}I_1\dot{\theta}_1^2 + \frac{1}{2}I_2(\dot{\theta}_1 + \dot{\theta}_2)^2 + \frac{1}{2}m_2 l^2\dot{\theta}_1^2 \tag{1}$$

$$U = (m_1 l_G + m_2 l)g\cos\theta_1 \tag{2}$$

The derivatives represented by generalized coordinates and generalized velocity are expressed by the following:

$$\frac{\partial T}{\partial \dot{\theta}_1} = I_1\dot{\theta}_1 + I_2(\dot{\theta}_1 + \dot{\theta}_2) + m_2 l^2\dot{\theta}_1 \tag{3}$$

$$\frac{\partial T}{\partial \dot{\theta}_2} = I_2(\dot{\theta}_1 + \dot{\theta}_2) \tag{4}$$

-continued $$\frac{\partial T}{\partial \theta_1} = 0 \tag{5}$$

$$\frac{\partial T}{\partial \theta_2} = 0 \tag{6}$$

$$\frac{\partial U}{\partial \theta_1} = -(m_1 l_G + m_2 l) g \sin\theta_1 \tag{7}$$

$$\frac{\partial U}{\partial \theta_2} = 0 \tag{8}$$

Equations (3) to (8) are substituted into Lagrange's equations Eqs. (9) and (10).

$$\frac{d}{dt}\left(\frac{\partial T}{\partial \dot{\theta}_1}\right) - \frac{\partial T}{\partial \theta_1} + \frac{\partial U}{\partial \theta_1} = \tau_1 \tag{9}$$

$$\frac{d}{dt}\left(\frac{\partial T}{\partial \dot{\theta}_2}\right) - \frac{\partial T}{\partial \theta_2} + \frac{\partial U}{\partial \theta_2} = \tau_2 \tag{10}$$

As a result, as the equation of motion, the following Eqs. (11) and (12) are obtained.

$$I_1\ddot{\theta}_1 + I_2(\ddot{\theta}_1 + \ddot{\theta}_2) + m_2 l^2 \ddot{\theta}_1 - (m_1 l_G + m_2 l) g \sin\theta_1 = \tau_1 \tag{11}$$

$$I_2(\ddot{\theta}_1 + \ddot{\theta}_2) = \tau_2 \tag{12}$$

When Eq. (12) is transformed, it becomes Eq. (13).

$$\ddot{\theta}_2 = \frac{\tau_2}{I_2} - \ddot{\theta}_1 \tag{13}$$

When this is substituted into Eq. (11) and $\sin\theta_1$ is approximated by $\theta_1$, the following is obtained.

$$(I_1 + m_2 l^2)\ddot{\theta}_1 - (m_1 l_G + m_2 l) g \theta_1 = \tau_1 - \tau_2 \tag{14}$$

Equation (14) shows that the motion of the body is independent of the angle and the angular velocity of the inertia rotor 8.

Estimation of Inclination Angle of Body

The inclination angle of the body can be determined by integration of an output from the gyro sensor 7. However, because deviations are accumulated and this leads to inaccuracy, it is necessary to determine the inclination angle in another way. To this end, a current inclination angle is estimated by use of the equation of motion from a measurement value of the inclination angular velocity of the body output from the gyro sensor 7 and the motor torque. When the equation of motion Eq. (14) is transformed, it becomes $$\theta_1 + \frac{\tau_1}{(m_1 l_G + m_2 l) g} = \frac{\tau_2 + (I_1 + m_2 l)\ddot{\theta}_1}{(m_1 l_G + m_2 l) g} \tag{15}$$

When the measurement value of the inclination angular velocity of the body output from the gyro sensor 7 is $\omega_1$, the following is obtained.

$$\ddot{\theta}_1 \cong \dot{\omega}_1 \tag{16}$$

An apparent balanced inclination angle when the distribution torque $\tau_1$ is present is given by the following:

$$-\frac{\tau_1}{(m_1 l_G + m_2 l) g} \tag{17}$$

As a result, from Eq. (15), the deviation of the current inclination angle from the apparent balanced inclination angle can be estimated by the following:

$$\tilde{\theta}_1 \equiv \theta_1 - \left(-\frac{\tau_1}{(m_1 l_G + m_2 l) g}\right) \equiv \frac{\tau_2 + (I_1 + m_2 l^2)\dot{\omega}_1}{(m_1 l_G + m_2 l) g} \tag{18}$$

It is preferable that a first-order lag element be added in series to stabilize a loop by making it have an appropriate estimated speed.

Feedforward of External Torque

The external torque is compensated for by use of a deviation angle estimated by Eq. (18). The following is added to the torque.

$$\tilde{\tau}_2 = (m_1 I_G + m_2 l) g \tilde{\theta}_1 \tag{19}$$

When $$\tau_2 = \hat{\tau}_2 + \tilde{\tau}_2 \tag{20}$$

then the equation of motion Eq. (14) becomes $$(I_1 + m_2 l^2)\ddot{\theta}_1 = -\hat{\tau}_2 \tag{21}$$

Therefore, the external torque can be compensated for.

Generation of Target Inclination Angle

The rotational speed $\dot{\theta}_2$ of the inertia rotor 8 gathers in the integral form of Motion equation 2 (Eq. (13)). Because there is a limit to the rotational speed of the motor, it is necessary to perform compensation using positional control so as to reduce the gathered rotational speed by utilizing the gravity torque. To this end, the target inclination angle is determined in a manner described below.

If it is assumed that the inclination angle is constant while the rotational speed is reduced by use of the gravity torque, the following is satisfied:

$$\ddot{\theta}_1 = 0 \tag{22}$$

Therefore, the equation of motion Eqs. (14) and (13) becomes Eqs. (23) and (24), respectively.

$$\tau_2 = \tau_1 + (m_1 l_G + m_2 l) g \theta_1 = (m_1 l_G + m_2 l) g \tilde{\theta}_1 \tag{23}$$

$$\ddot{\theta}_2 = \frac{\tau_2}{I_2} = \frac{(m_1 l_G + m_2 l) g \tilde{\theta}_1}{I_2} \tag{24}$$

To reduce the gathered rotational speed $\dot{\theta}_2$ with time $T_A$, the necessary angular acceleration is given by $$\ddot{\theta}_2 = -\frac{\dot{\theta}_2}{T_A} \tag{25}$$

Hence, from a comparison of Eqs. (24) and (25), the following is determined.

$$\tilde{\theta}_1 = -\frac{I_2\dot{\theta}_2}{T_A(m_1 l_G + m_2 l)g} \tag{26}$$

As a result, Eq. (27) can be set as the target value for the positional loop (target inclination angle).

$$\theta_r = -\frac{I_2\dot{\theta}_2}{T_A(m_1 l_G + m_2 l)g} \tag{27}$$

The reduction time $T_A$ can be set as $T_A$=1 sec, for example.

In theory, no steady-state deviation remains in the inclination angle estimating portion 25, such that an integration element is not required for generation of the target inclination angle. However, in actuality, a low-speed steady rotation may remain in the inertia rotor 8. This can be caused by an offset of the D/A converter. Although there would be no problem if nothing is processed, the low-speed steady rotation can be cancelled by the addition of an integrator having a time constant preferably on the order of about 10 seconds, for example, to a portion for generating the target inclination angle.

Figure 6:
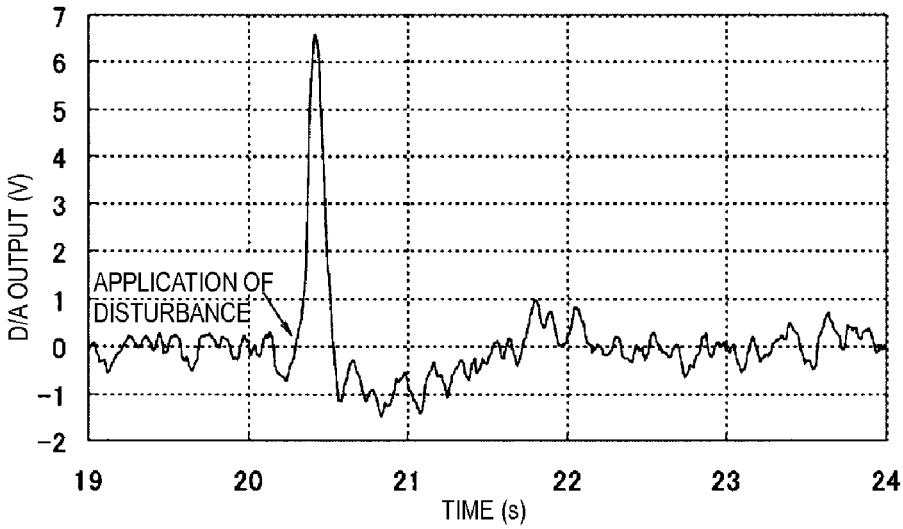
FIG. 6 shows a motor torque command when a disturbance is applied.
Figure 7:
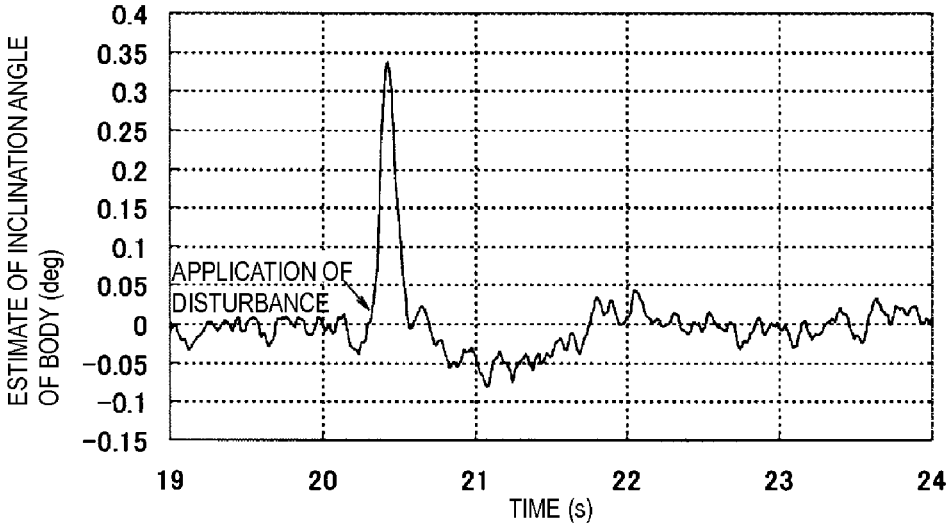
FIG. 7 shows an estimate of an inclination angle of the body when a disturbance is applied.

The results of the measurement of stability of the bicycle robot including the inertia rotor based on the above principle are shown in FIGS. 5 to 7. FIGS. 5 to 7 show responses that occur when the bicycle robot which is not subjected to the application of a disturbance undergoes an application of a disturbance by laterally pushing the body with a finger. FIG. 5 shows an angular velocity of the body measured by the gyro sensor. FIG. 6 shows a motor torque command (rated torque: about 3 V, for example). FIG. 7 shows an estimate of an inclination angle of the body. The sampling time is preferably about 1 ms, for example.

As shown in FIG. 7, the estimate of the inclination angle is stably maintained within about ±0.05 deg until a disturbance is applied, and it reveals that a stable balanced state is maintained. Additionally, even when a disturbance is applied, the bicycle robot immediately returns to a stable position. From the experimental results, it has been shown that the bicycle robot according to preferred embodiments of the present invention can stop without overturning and can compensate for a disturbance (including a steady-state stepped disturbance).

Because the inclination angle is estimated on a model basis without the integration of an output from the gyro sensor 7, even when the output from the gyro sensor 7 includes a noise or offset, the estimation of the inclination angle continues and control to prevent the bicycle from overturning continues. Accordingly, a bicycle that does not overturn during stops or while moving at a very low speed is obtained.

The inclination angle can be controlled by the estimation of the inclination angle on the basis of an output from the gyro sensor 7 and by utilizing a reaction of the torque applied to the inertia rotor 8 from the balance motor. Accordingly, a bicycle that does not overturn during stops or while moving at a very low speed is obtained.

In the estimation of the inclination angle, the inclination angle is determined from a balanced state. Therefore, even when a disturbance torque, such as the centrifugal force during travel around a curve, is present in addition to gravity torque, an external torque produced by the inclination angle from the balanced state can always be estimated. Thus, a correction torque that cancels the disturbance torque can be calculated. Accordingly, even when a disturbance torque is present, the balance of the body can be maintained.

Compensating for an external torque using feedforward control enables overturn prevention control to continue even when the response frequency of each of the inclination angle loop and the inclination angular velocity loop is low. Accordingly, stable control can be performed.

Because the target inclination angle is generated so as to prevent the rotational speed of the inertia rotor from exceeding its limit, the inclination angle can be changed before the rotational speed of the motor exceeds its limit, and the angular momentum of the inertia rotor 8 can be released by utilizing the gravity torque. Accordingly, the control device continues control to prevent overturning even during stops or while the bicycle robot moves at a very low speed.

When the inclination angle is left when viewed from the front of the bicycle, in order to maintain that attitude, it is necessary to accelerate the inertia rotor 8 in the direction of left-handed rotation when viewed from the front of the bicycle. When the inclination angle is right when viewed from the front of the bicycle, in order to maintain that attitude, it is necessary to accelerate the inertia rotor 8 in the direction of right-handed rotation when viewed from the front of the bicycle. Accordingly, when the rotational speed of the motor is large, the rotational speed of the motor can be reduced by actively tilting the attitude and the release of the angular momentum of the inertia rotor 8 using the gravity torque. Such control can be performed because the inertia rotor 8 is mounted on the rotating shaft, and thus, the length of time before the rotational speed of the motor exceeds its limit is sufficient.

In the generation of a target inclination angle, the target inclination angle is obtained by multiplying the rotational speed of the motor by a proportionality constant such that, when the rotational speed of the motor indicates a left rotation when viewed from the front of the bicycle, the target inclination angle is rightward when viewed from the front of the bicycle and, when the rotational speed of the motor indicates a right rotation when viewed from the front of the bicycle, the target inclination angle is leftward when viewed from the front of the bicycle. Because an integrator is also provided, no steady rotation resulting from the offset of the D/A converter remains.

In the foregoing preferred embodiment, control for preventing the bicycle robot from overturning is described. However, the present invention is not limited to this preferred embodiment. For example, the present invention is applicable to control for preventing overturning of an inversion control toy, as described in Japanese Unexamined Patent Application Publication No. 11-47454, or a biped robot. That is, in the case of a biped robot, walking that is always stable can be achieved by estimating the inclination angle from the balanced axis. Moreover, the present invention is applicable to control for preventing overturning of a two-wheel vehicle, such as a motorcycle, during a temporary stop. The mathematical expression for estimating the inclination-angle deviation is represented by Eq. (18). However, this is merely an example. The expression for estimating the inclination-angle deviation may vary depending on the particular application.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. An overturn prevention control device comprising:

a body capable of freely laterally inclining;

an angular velocity sensor mounted on the body such that a detection axis thereof extends in a substantially longitudinal direction of the body;

a motor mounted on the body and including a rotating shaft extending in a substantially longitudinal direction of the body;

a rotation sensor that detects at least one of a rotational position and a rotational speed of the motor;

an inertial rotor coupled to the rotating shaft of the motor; and an inclination angle estimating portion arranged to estimate an inclination angle of the body relative to a balanced state from an angular velocity output $\omega_1$ from the angular velocity sensor and a torque command $\tau_0$ to be supplied to the motor; wherein the overturn prevention control device corrects an inclination of the body by rotating the inertial rotor using the motor and by utilizing a reaction torque occurring when the inertial rotor is rotated; and the overturn prevention control device corrects the inclination of the body using an estimate of the inclination angle estimated by the inclination angle estimating portion.

2. The overturn prevention control device according to claim 1, further comprising:

an inclination angular velocity command generating portion arranged to generate an inclination angular velocity command $\omega_2$ using an inclination angle deviation signal in which the estimate of the inclination angle is subtracted from a target inclination angle; and a torque command generating portion arranged to generate the torque command $\tau_0$ to be supplied to the motor using an inclination angular velocity deviation signal $\omega_2 - \omega_1$, in which the angular velocity output $\omega_1$ from the angular velocity sensor is subtracted from the inclination angular velocity command $\omega_2$.

3. The overturn prevention control device according to claim 2, further comprising:

an external torque estimating portion arranged to estimate an external torque that urges the body to fall based on the estimate of the inclination angle; and a torque correcting portion arranged to correct the torque command $\tau_0$ in a direction in which the external torque is cancelled using an estimate $\tau_3$ of the external torque.

4. The overturn prevention control device according to claim 2, further comprising a target inclination angle generating portion arranged to generate the target inclination angle using the rotational speed of the motor in a direction in which the rotational speed is reduced.

5. The overturn prevention control device according to claim 1, wherein the body is a two-wheel vehicle having a steering portion, a front wheel steerable by the steering portion, a rear wheel, a rear-wheel driving portion that drives the rear wheel, and a frame that freely rotatably supports the front wheel and the rear wheel.

* * * * *